US007437852B2

(12) United States Patent
Dufour et al.

(10) Patent No.: US 7,437,852 B2
(45) Date of Patent: Oct. 21, 2008

(54) SLIDING WINDOW APPARATUS

(75) Inventors: William T. Dufour, Macomb Township, MI (US); Kenneth E. Keck, Clinton Township, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 707 days.

(21) Appl. No.: 11/050,971

(22) Filed: Feb. 4, 2005

(65) Prior Publication Data

US 2006/0174544 A1 Aug. 10, 2006

(51) Int. Cl.
*E05D 15/10* (2006.01)

(52) U.S. Cl. ..... 49/213; 49/214; 49/220; 49/380; 49/413

(58) Field of Classification Search ..... 49/116, 49/213, 380, 413, 214, 220, 254
See application file for complete search history.

(56) References Cited

U.S. PATENT DOCUMENTS

| | | | |
|---|---|---|---|
| 4,561,224 | A | 12/1985 | Jelens |
| 4,800,681 | A | 1/1989 | Skillen et al. |
| 4,850,139 | A | 7/1989 | Tiesler |
| 5,542,214 | A | 8/1996 | Buening |
| 5,996,284 | A | 12/1999 | Freimark et al. |
| 2006/0032140 | A1 * | 2/2006 | Arimoto et al. ..... 49/209 |

FOREIGN PATENT DOCUMENTS

| | | | |
|---|---|---|---|
| EP | 0 857 844 | A1 | 8/1998 |
| EP | 0 968 862 | A2 | 1/2000 |
| EP | 0968862 | B1 | 1/2000 |
| FR | 2 833 212 | A | 6/2003 |

OTHER PUBLICATIONS

European Search Report for corresponding EP 1 688 574 A3.

* cited by examiner

*Primary Examiner*—Katherine Mitchell
*Assistant Examiner*—Michael Keller
(74) *Attorney, Agent, or Firm*—Peter D. McDermott; Banner & Witcoff Ltd.; Dean B. Watson

(57) ABSTRACT

A sliding window assembly has at least one sliding pane mounted for travel along a travel path between a closed position in a first plane and an open position in an offset second plane substantially parallel to the first plane. The window assembly has travel guide apparatus for guiding its movement along the travel path between the open and closed positions. The travel guide apparatus includes a track defining an elongate slot corresponding to the travel path, a fixed guide surface having a fixed position relative to the track, e.g., a pivot pin, and components cooperatively operative as a cam and slide movement for guiding travel of the sliding pane between its open and closed positions. Typically, for generally rectilinear sliding panes, a track, guide surface and cam and slide movement are provided for each corner of the sliding pane. The cam and slide movement comprises a traveler mounted for longitudinal travel in the track and having an elongate slot at an angle to the main travel path, a travel pin mounted to the sliding pane and extending into the elongate slot of the track and the traveler slot, and a cam mounted to the sliding pane. The cam is operative to contact the fixed guide surface as the sliding pane approaches the closed position, to guide the sliding pane from the offset second plane to the first plane as the sliding pane travels further toward the closed position.

19 Claims, 8 Drawing Sheets

SLIDING WINDOW APPARATUS

The present invention is directed to a window assembly for a motor vehicle and, more particularly, to a motor vehicle window pane assembly, optionally a multi-pane window assembly, providing guidance for a movable pane as it slides between open and closed positions. In certain exemplary embodiments such sliding pane in its closed position is substantially flush with one or more adjacent fixed-position panes and, in its open position, overlaps a fixed-position pane in an offset, parallel plane.

BACKGROUND

There is a need for well-functioning window assemblies suitable to present an integrated and flush appearance in a motor vehicle. It is particularly desirable to provide multi-pane window assemblies wherein at least one pane is slidably mounted for movement between an open position and a closed position, which can be integrated into a window opening to provide a substantially flush overall appearance.

Window assemblies intended for use as openable rear windows for pickup truck cabs, for example, typically include a frame holding one or more fixed panes and a sliding pane. Such window assemblies typically include a metal or plastic frame in which the glass or plastic panes are mounted.

Multi-pane window assemblies shown in U.S. Pat. No. 4,920,698 to Friese et al. (the entire disclosure of which is hereby incorporated by reference herein for all purposes) include right and left side fixed panes and a sliding center pane powered by an electric motor. In the powered sliding truck cab window assembly of Friese et al the center pane is not flush with the side panes. Rather it is recessed inboard, i.e., into or toward the passenger compartment of the truck, such that it can slide laterally behind one or the other of the fixed panes to open the window. Thus, the center sliding pane does not contribute to an overall flush appearance. In the flush sliding pane window assemblies shown in U.S. Pat. No. 4,850,139 to Tiesler (the entire disclosure of which is hereby incorporated by reference herein for all purposes), the sliding window is manually operated to slides in slots between open and closed positions. The slots have wider-width portions to permit one side of the sliding pane to be pulled manually out of flushness with the adjacent fixed pane and thereafter slid laterally behind the adjacent fixed pane. In U.S. Pat. No. 5,542,214 to Beuning (the entire disclosure of which is hereby incorporated by reference herein for all purposes), guide means for guiding the sliding pane as it moves laterally between its open and closed positions includes fixed members extending from the sliding panes substantially perpendicular to its direction of travel and kick-out means provided by the frame for engaging the fixed members at least during initial lateral movement of the sliding pane from its closed position to its open position. The kick-out means engages the fixed members to force the sliding pane from the plane flush with that of the adjacent fixed-position pane(s) to an offset parallel plane substantially simultaneously with such initial lateral movement of the sliding pane from its closed position.

Motor vehicle design requirements are often stringent and demanding. Design techniques suitable for other uses may not be adequate for motor vehicle applications. Accordingly, improved and alternative designs are needed for motor vehicle window assemblies with one or more openable panes, having good functionality (e.g., ease of operation, robustness of design for the sometimes harsh environments of motor vehicle usage, resistance to weather, noise and contaminants infiltration when in the closed position, and/or other characteristics), ease of integration or "packaging" (e.g., fitting well with and/or mounting to other nearby components), good manufacturability, and the like. It is an object of the present invention to provide motor vehicle window assemblies that address some or all of these requirements. Additional objectives and characteristics of all or at least certain exemplary embodiments of the invention will be apparent to those skilled in the art given the benefit of this disclosure.

SUMMARY

In accordance with one aspect, a sliding window assembly has at least one sliding pane mounted for travel along a travel path between a closed position and an open position. In the closed position the sliding pane lies in a first plane and in the open position it lies in a parallel plane. The window assembly includes travel guide apparatus for guiding the sliding pane as it moves along the travel path between the open and closed positions. In certain exemplary embodiments such travel guide apparatus is provided at each of the four corners of a rectilinear sliding pane (e.g., at the corners of a molded frame surrounding all or a portion of the peripheral edge of the sliding pane). The travel guide apparatus comprises at least one track defining an elongate slot along the travel path, at least one fixed guide surface, e.g., a pivot pin, which may be integral or unitary with the track and in any event has a fixed position relative to the elongate slot, and a cam and slide movement. An end portion of the elongate slot is configured for the initial movement of the sliding pane from the closed position in one plane to the open position in a parallel, offset plane (and the reverse for travel toward the closed position). In certain exemplary embodiments such end portion of the elongate slot is arcuate and curves around the aforesaid pivot pin or other guide surface. The cam and slide movement comprises a traveler mounted for longitudinal travel along (e.g., in, on, under, etc.) the track. The traveler (alternatively referred to as a slide or yoke) has a traveler slot which extends at an angle to the elongate slot of the track. That is, the traveler slot is not parallel to the elongate slot of the track. In certain exemplary embodiments the traveler slot is at an angle of 30° to 90° to the main travel direction. As explained further below, the traveler in certain exemplary embodiments is attached to a cable for power operation of the sliding window. The cam and slide movement further comprises a travel pin extending from the sliding pane to the elongate slot of the track and the traveler slot. The cam and slide movement further comprises a cam. Optionally, the travel pin and cam can be integral with one another, e.g., as part of a cam rod rotatably mounted to the sliding pane. As indicated above, it typically will be advantageous to have such travel pin, cam and other components of the cam and slide movement at each corner of the sliding pane. Optionally, therefore, a cam rod extending upwardly from an upper left corner of a sliding pane can be integrated or even unitary (i.e., one piece) with each other. The cam is operative to contact the fixed pivot pin or other guide surface to provide travel guidance as the sliding pane approaches the closed position. In certain exemplary embodiments the cam has an angled lead in surface to receive a fixed pivot pin. Such angled lead-in, e.g., on the bottom of the cam, can serve to constrain cam translation (i.e., movement in the lateral direction of sliding pane travel). The travel pin (and, therefore, also the sliding pane) is in fixed position relative to the cam and is guided in the end portion of the elongate slot by the rotational bearing of the cam against the pivot pin at the end of the travel path. In certain exemplary embodiments the track pivot pin and the travel pin are in line and parallel with each other. The travel pin follows the travel path defined by the configured end portion of the elongate slot in the track, controlled also by the angled slot of the traveler. In certain exemplary embodiments a stop surface or the like is provided by the track for the traveler at the end of the travel path to prevented further travel.

At the end of the elongate slot, as indicated above, the elongate slot is configured, that is, it is not merely a straight continuation of the axial direction of travel over the main part of the travel path. More specifically, the elongate slot is configured for movement of the sliding pane into the plane of the closed position (or into the offset parallel plane of the open position if the pane is moved from the closed position to the open position). The angle of the traveler slot accommodates such movement, e.g., arcuate travel (depending on the configuration of the end portion of the elongate slot) between the plane of the open position and the plane of the closed position (or between the plane of the closed position and the plane of the open position). That is, travel into (or out of) the closed position is guided by contact of the cam against the fixed guide surface in cooperation with the guidance of the travel pin in both the elongate slot of the track and the angled slot of the traveler.

As noted above, the sliding pane may have a generally rectilinear shape, e.g., a square or rectangular shape, and the travel guide apparatus may provide guidance for the sliding pane at all four corners. In such embodiments, the travel guide apparatus preferably includes two spaced, parallel tracks, e.g., two horizontal tracks or two vertical tracks, each with an elongate slot and a fixed pivot pin or other guide surface for one corner and an elongate slot and a fixed guide surface for a second corner. Thus, two tracks in such embodiments provide travel guide apparatus for all four corners of a rectilinear sliding pane. The two tracks cooperatively provide travel guidance to the sliding pane, e.g., one track above and a parallel track below the sliding pane for horizontal sliding or one to the right and a parallel one to the left for horizontal or vertical sliding, etc. Thus, a first edge of the sliding pane between its first and second corners travels along (e.g., in or adjacent) the first track, and a second edge of the sliding pane opposite the first edge, between third and fourth corners of the sliding pane, travels along the second track. In certain exemplary embodiments two horizontal tracks—parallel each other in the same horizontal plane (ignoring the fact that the tracks may not be somewhat curved or otherwise not perfectly straight and, therefore, not perfectly parallel to each other in a strict sense)—guide a horizontal sliding pane that travels horizontally in such horizontal plane, e.g., in the case of a so called sun roof or moon roof for the passenger compartment of a motor vehicle. In certain exemplary embodiments two horizontal tracks—one above the other, i.e., parallel each other in the same vertical plane (again treating parallelism here and throughout this disclosure and in the claims as a general concept rather than only in its strict geometry sense)—guide a vertical sliding pane that travels horizontally in such vertical plane. In other exemplary embodiments of the sliding window assemblies disclosed here, vertical parallel tracks guide a sliding pane that travels vertically in a vertical plane, e.g., in the case of a side or rear window for the passenger compartment of a truck or car.

Optionally, the guide surface associated with an elongate slot in a track can be integral or even unitary with the track and positioned in a slideway formed by the track, i.e., an elongate groove or recess in the track extending along the travel path to receive a side edge of the sliding pane itself, an edge of a frame surrounding all or part of the pane, support members extending from the sliding pane, or the like. Optionally the cam of the travel guide apparatus can provide a support surface to bear against such slideway.

In certain exemplary embodiments wherein multiple travelers are provided, e.g., at each of the four corners of a rectilinear sliding pane, travelers in the same track (e.g., the two travelers in the same track extending under a sliding pane) optionally may be connected with suitable linkage, e.g., a link member or the like, between the two travelers to synchronize their drive force on the sliding pane and/or the travel guidance provided by the travel guide apparatus for the sliding pane at their respective corners. Alternatively, a single traveler can be provided which extends from one corner to the other, having an angled traveler slot for the travel pin at each of the corners of the sliding pane. Also, as discussed further below, in certain embodiments linkage is provided between the travel guide apparatus components associated with one track and the travel guide apparatus components associated with a second track, to synchronize the travel guidance provided at the opposite sides (e.g., at parallel opposite side edges) of the sliding pane.

In accordance with another aspect, a sliding window assembly comprises a combination of features or components including, at least one fixed-position pane and at least one sliding pane mounted for sliding travel relative to the fixed-position pane to open and close the window. As described above, the sliding pane travels along a travel path between its closed position in a first plane, and its open position in an offset second plane substantially parallel to the first plane. The window assembly also includes travel guide apparatus for the sliding pane as described above. In certain exemplary embodiments the track(s) may be formed in a window frame extending circumferentially (either fully or partially) around the window assembly. For example, a molded frame, e.g., a plastic molded frame, such as a reaction injection molded or otherwise molded frame can be configured with slots, rabbits, trackways, etc to accommodate the sliding pane(s) and also the fixed pane(s) of the window assembly in a self-supporting assembly suitable to withstand the forces typically encountered in manufacture, assembly, shipping and handling, installation, removal for repair, etc. Alternatively, one or more separate tracks can be included in the sliding window assembly to provide for such features.

Especially where the travel guide apparatus disclosed above is used at all four corners of an essentially square or rectangular sliding pane (such terms allowing, of course, for the particular shape details and any curvature of the sliding pane called for by the particular window opening in which the window assembly will be used), in combination or cooperatively with other features or components of the window assembly, effective travel guidance can be provided for the sliding pane through an initial movement from its closed position. In certain exemplary embodiments such initial travel from the closed position can include travel at an angle of 90° or almost 90° to the overall longitudinal direction of travel toward the full open position. Thus, the sliding pane in such embodiments can move to the offset plane of the open position during an advantageously small amount of lateral travel, i.e., travel in the direction of the main elongate portion of the travel path. As used here, in some instances "lateral travel" will be used to refer to the primary or overall direction of travel between the closed and full open positions of the sliding pane. Typically, in certain exemplary embodiments having a fixed pane as well as the sliding pane, the sliding pane will slide behind or in front of the fixed pane in an offset plane parallel to the plane of the fixed pane. It is a consequent advantage of certain exemplary embodiments of the invention that the sliding pane(s) in the closed position can be essentially flush with adjacent fixed pane(s) when in the closed position, which is especially desirable, for example, in vehicle and architectural applications of the sliding window assemblies disclosed here calling for openable windows that preserve a smooth exterior appearance for design and/or aerodynamic purposes. Moreover, in such exemplary embodiments, especially, e.g., those designed for use as a window in a motor vehicle, the gap between the vertical edge of a fixed pane and the vertical edge of an adjacent sliding pane in the closed position can be advantageously small, e.g., as small as 3.0 mm or even less in some cases, thereby further facilitating the flush appearance. Such embodiments of the window assemblies disclosed here can provide excellent performance against wind noise, water leaks, etc.

It is a further significant advantage that certain exemplary embodiments of the window assemblies disclosed here are readily adapted for manual or power designs, especially, e.g., for vehicle window applications. In certain cases a window design in accordance with the principles disclosed here can be used for both a power model and a manual model with only minor design changes. In particular, the traveler, operating cooperatively or in combination with other components in typical embodiments of the disclosed window assemblies, is well suited to either or both manual and power operation.

In accordance with another aspect, a sliding window assembly comprises at least one sliding pane mounted for travel along a travel path between a closed position in a first plane and an open position in an offset second plane substantially parallel to the first plane. Optionally, the sliding pane may be fully or partly framed, e.g., by a molded plastic frame on some or all of the perimeter of the pane. In certain exemplary embodiments the molded frame may provide projections, in some cases referred to as ride bumps, projecting to the first track and supporting the sliding pane in the first track It should be understood that references to the "sliding pane" in this disclosure and in the appended claims is intended to include both framed and unframed panes unless otherwise stated or clear from context. Travel guide apparatus for guiding the sliding pane as it moves along the travel path between the open and closed positions comprises a track forming an elongate slot. The elongate slot has a main elongate portion extending along the travel path in a plane corresponding to the offset second plane, and a configured end portion, e.g., an arcuate end portion or the like, extending from the main elongate portion toward the first plane. A fixed guide surface has a fixed position relative to the elongate slot proximate the end portion. As used here, the fixed guide surface, e.g., a pivot pin, is "proximate the end portion" if it is at the end portion or so close to the end portion as to suitably engage the cam and slide movement for guidance of the sliding pane from the offset plane of the open position toward the plane of the closed position. In certain exemplary embodiments the fixed guide surface may be unitary with the track. In embodiments where a fixed pivot pin is used and the end portion of the elongate slot is arcuate, the pivot pin optionally is located proximate the radial center-point of the arc. It should be understood that the arcuate configuration may be a segment of a circle or a different curve suitable to the requirements of the particular application for which the window assembly is intended. The cam and slide movement comprises a traveler slidably mounted in the track for longitudinal travel along the elongate slot. In certain exemplary embodiments the traveler is slidably captured in a channel or trackway formed by the track. As described above, the traveler may be connected to a cable for power or manual operation of the sliding pane. The traveler has an elongate traveler slot extending longitudinally at an angle, e.g., an angle of about of 30° to 90° to the main elongate portion of the elongate slot. The cam and slide movement also includes a travel pin extending from the sliding pane to the elongate slot of the track and the traveler slot. A cam rotationally fixed to the travel pin is mounted to the sliding pane and operative to contact the fixed guide surface as the sliding pane approaches the closed position. The cam and travel pin in certain exemplary embodiments are parts of a cam rod extending from the sliding pane. The cam rotatably bears against the first fixed guide surface to guide the travel pin into the configured end portion of the elongate slot, and in so doing, the sliding pane is moved from the offset second plane toward the first plane as it travels toward the closed position.

In certain exemplary embodiments of the sliding window assemblies disclosed here, the cam and the travel pin can be integrated at one end of a rod, in some instances referred to here as a mounting rod, which is rotatably attached to the sliding pane. For example, the mounting rod may be attached along a first vertical side of a frame on a horizontally sliding pane, such as a rear window of a passenger compartment of a truck or car or the like, and extend beyond the frame (e.g., vertically below or above) to a track. Optionally, the mounting rod extends beyond the sliding pane in both directions (e.g., vertically above the top and below the bottom of a sliding pane mounted in a vertical plane, or horizontally beyond the right and left sides of a horizontally mounted sliding pane), providing a cam and travel pin at each end. In certain exemplary embodiments involving a rectilinear sliding pane, a pair of two-ended mounting rods as just described is used, one for each of two opposite sides of the sliding pane, to provide support and travel guidance at all four corners of the sliding pane. As noted above, the cam bears against the pivot pin or other guide surface at the end portion of the elongated slot in the track. Optionally the cam has a recess that receives the guide surface as the sliding pane reaches or approaches the end portion of the slot and then rotates as it bears against the guide surface. Optionally, a surface area of the cam or other portion of such mounting rod can cooperate with the travel pin to support the sliding pane in the track (especially in the case of cam rods extending downwardly beyond the sliding pane to support the sliding pane against gravity, etc.) or to hold the sliding pane in position in the window assembly, e.g., against inboard/outboard forces, etc.

In accordance with another aspect, a flush-closing multi-pane window assembly for a motor vehicle body enclosing a passenger compartment comprises a window assembly frame, at least one fixed-position pane mounted vertically in the window assembly frame, at least one sliding pane assembly mounted vertically in the window assembly frame for travel horizontally between a closed position in which the outside surface of the sliding pane is flush with the outside surface of the fixed-position pane, and an open position in which the sliding pane assembly at least partly overlaps the fixed position pane in an offset second plane parallel to the first plane, and travel guide apparatus. The sliding pane is generally rectilinear and has a molded frame extending along at least a portion of its perimeter edge. The travel guide apparatus is operative to guide the sliding pane assembly as it moves along its travel path between the open and closed positions. The travel guide apparatus comprises an elongate horizontal first track mounted horizontally in a fixed position in the window assembly frame below the sliding pane assembly and an elongate horizontal second track mounted horizontally in a fixed position in the window assembly frame parallel to the first track and above the sliding pane assembly. The first track provides a longitudinally extending first slideway providing support for a first lower corner of the sliding pane assembly, longitudinally extending first trackway below the first slideway, a first elongate slot through the first slideway to the first trackway, a longitudinally extending second slideway generally aligned with the first slideway and providing support for a second lower corner of the sliding pane assembly, longitudinally extending second trackway below the second slideway (e.g., simply an extension of the first trackway, optionally with one or more stop surfaces or the like between them), and a second elongate slot through the second slideway to the second trackway. The two elongate slots each comprises a main elongate portion extending along the travel path in a plane corresponding to the offset second plane, and a configured end portion corresponding to the closed position. The elongate horizontal second track mounted above the sliding pane assembly forms longitudinally extending third and fourth slideways similar to the first and second slideways and longitudinally extending third and fourth trackways above the third and fourth slideways, respectively, and third and fourth elongate slots through the corresponding slideway to the corresponding trackway. The third and fourth elongate slots are similar to the first and second such slots, comprising a main elongate portion extending along the travel path in the offset second plane and a configured end portion corresponding to the closed position. A fixed pivot pin or other guide surface is integral with the track at the end portion of each of the elongated slots. A cam and slide movement is provided at each corner of the sliding pane assembly. The cam and slide movements each comprises a traveler slidably mounted for longitudinal travel in the respective trackway, with an elongated traveler slot extending at an angle of 30° to 90° to the main elongate portion of the respective elongate slot. The cam and slide movements also each has a cam rod mounted to the sliding pane assembly and extending vertically beyond the respective corner of the sliding pane assembly. The cam rods each comprises a vertically extending rod, a cam integral with the rod and rotatable in a plane perpendicular to the longitudinal axis of the rod, and a travel pin integral with the rod and extending to the respective elongate slot of the respective track and the respective elongate traveler slot of the respective traveler. In accordance with certain exemplary embodiments the cam is slidingly received in the respective slideway and has a recess operative to receive the respective fixed pivot pin as the sliding pane approaches the closed position and to rotatably bear against the pivot pin to urge the sliding pane from the offset second plane toward the first plane as the sliding pane travels further toward the closed position. In certain exemplary embodiments the cam rod at the first upper corner and the cam rod at the first lower corner (optionally referred to as the left side corners or the right side corners) are unitary with each other or otherwise coupled for synchronized rotation, e.g., by a coupler mounted to a vertical portion of the molded frame extending along the vertical edge of the sliding pane between those two corners. In certain such embodiments the sliding window assemblies further comprise a manually operable handle mounted to the molded frame of a sliding pane, e.g., at about the vertical midpoint along one side, for limited rotation about a vertical axis. Such handles are operative to rotate the aforesaid coupler for synchronized rotation of the cam rod at the upper and lower corners. Such rotation provides guidance for the upper and lower travel pins to travel out of the end portion of the elongate slot in the respective track, thereby moving the sliding pane to the offset parallel plane as the window is first opened. Optionally, a rotational biasing member is provided, that is operative to rotationally bias the handle, e.g., to the closed or open condition. Also, in certain exemplary embodiments at least one vertical biasing member is operative to vertically bias at least one cam rod, optionally all of the cam rods. Such biasing can assist in holding the sliding pane in proper vertical position, thereby reducing or eliminating rattle noise, vibration and the like.

It will be apparent to those skilled in the art given the benefit of this disclosure, that suitable additional components may be included in a sliding window assembly according to the present disclosure. For example, one or more seals may be carried by the molded frame of the sliding pane or by a fixed pane, etc. to sealingly reduce or eliminate wind noise, and the infiltration of contaminants, water etc Optionally, for example, a seal carried by the sliding pane can seat against the inside surface of an adjacent fixed pane in the closed position.

Those skilled in the art will recognize that various advantages can be realized with at least certain exemplary embodiments of the window assemblies disclosed here. At least certain embodiments of the window assemblies disclosed here provide advantageous function during opening and closing of the sliding pane. Other advantages of the invention or of certain exemplary embodiments will be better understood in view of the detailed description provided below of certain exemplary embodiments.

BRIEF DESCRIPTION OF THE DRAWINGS

Certain exemplary embodiments of the window assemblies disclosed here are described below with reference to the appended drawings wherein:

FIG. 7 [Not Used]

Figure 1:
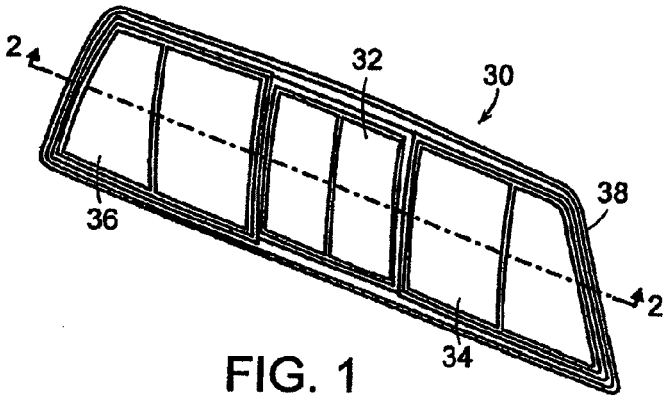
FIG. 1 is a schematic perspective illustration of a sliding window assembly in accordance with one embodiment of the present invention, comprising a center sliding pane mounted between right and left side fixed or stationary panes.
Figure 2:
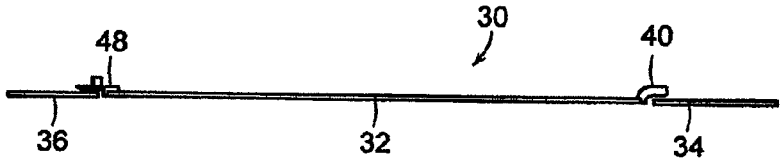
FIG. 2 is a schematic section view, partially broken away taken through line A of FIG. 1.

The same reference numeral may be used for a given feature or element in different drawings. It should be understood that the drawings are schematic and not necessarily to scale, to permit greater clarity in the disclosure and description of the invention. All directional references in the discussion below refer to the orientation shown in the drawings unless stated otherwise. It should be understood, however, that the window assemblies disclosed here can be used in many different applications and orientations, including, e.g., vertical and horizontal window applications, etc.

DETAILED DESCRIPTION OF CERTAIN EXEMPLARY EMBODIMENTS

It will be understood by those who are skilled in this area of technology that the window assemblies disclosed and described herein are suitable for use in numerous different applications, including especially as openable windows in passenger vehicles, e.g., cars, trucks, etc. Typically, a window assembly in accordance with this disclosure will be designed for a particular application, e.g., to fit into a particular gross window opening formed by a motor vehicle body. In certain exemplary embodiments an outer frame member of the egress window assembly together with other components of the assembly is structurally sufficient to support itself prior to installation into the gross opening provided in the motor vehicle body. Such "self supporting" window assemblies advantageously tolerate handling, storage and other such forces typically encountered during manufacture, shipping and installation of the window assembly into the body of a motor vehicle. In addition, they typically are well adapted to temporary removal from the vehicle body for maintenance, repairs, etc. For purposes of illustration, various preferred and alternative features and aspects of the invention are now described in the context of a window assembly suitable for use as an openable rear window for the passenger compartment of a truck or similar motor vehicle. It should be understood, however, that the invention is not limited to this particular application, either in general or as to its particular features and elements.

As used here (i.e., in this disclosure of the invention and detailed description of certain exemplary embodiments and in the appended claims) the description of the cam mounted to the sliding pane as being operative to contact the fixed guide surface of the travel guide apparatus as the sliding pane approaches the closed position means that it comes into contact with the guide surface as the sliding pane, while traveling toward its closed position, reaches a near-closed position, e.g., a position proximate the closed position. In certain exemplary embodiments this occurs during the last 10% or so of the travel range between the extreme ends of the sliding pane's travel range between the full open and completely closed positions, e.g., during the last 5% or even during the last 2%, 1% or less of the travel range between the full open and completely closed positions of the sliding pane. In certain exemplary embodiments the cam contacts the guide surface of the travel guide apparatus when the sliding pane, traveling toward the closed position, is within about 15 mm of its completely closed position, e.g., within 10 mm or even just when it is within the last 6 mm or less of lateral travel (i.e., travel in the plane of the sliding pane toward the closed position) to the closed position. It will be understood that the cam operates in the opposite fashion during the initial travel of the sliding pane from its closed position toward its open position. The cam mounted to the sliding pane can have any suitable configuration and orientation. The term "cam" is used here in its broadest sense, and is intended to have any and all of the various alternative meanings known to those skilled in the mechanical arts and the like, as well as any and all meanings consistent with one or more available dictionary definitions. For example, the cam can be configured to function in a manner consistent with the definition provided in Merriam-Webster's Online Dictionary, 10th Edition, i.e., as a rotating or sliding piece in a mechanical linkage used especially in transforming rotary motion into linear motion or vice versa. More generally, the cam may have any configuration, position and orientation suitable for the purpose of cooperating with the fixed guide surface and other components of the window assembly to translate lateral sliding travel of the sliding pane into inboard/outboard travel between the offset plane of the sliding pane's open position and the plane of its closed position.

The operation of the cam and slider movement of the slider window assemblies disclosed here may be referred to as an harmonic motion. In cooperation with the configured end of the elongate slot in the track, in which the travel pin moves as the sliding pane moves into and out of its closed position, the cam and slider movement allows the sliding pane in its closed position to sit flush with an adjacent stationary or static pane and yet be slidable to its open position by applying primarily lateral sliding force. As used here, the "lateral" direction is the direction of sliding in the offset second plane of the open position (i.e., the direction of sliding after the initial movement out of the closed position). In certain exemplary embodiments the cam and slider movement, which may be considered a variation of a so called scotch yolk, enables the sliding pane to move during the initial movement out of the closed position at an angle of almost 90° to the lateral direction of travel. Taking advantage of such a large departure angle in certain such embodiments allows the margin or gap between the sliding pane and an adjacent fixed pane to be advantageously small, in some designs sufficiently small as to simulate the appearance (from a typical viewing distance) of a single piece of glass. In certain exemplary embodiments such departure angle is greater than 75° and may even be greater than 85°, i.e., between 85° and 90°. In accordance with certain exemplary embodiments of the sliding window assemblies disclosed here, a cam and slider movement is provided at each corner of a rectilinear sliding pane. Such embodiments can provide positive closing force (in the closed position) at all four corners of the sling pane, and consequent good performance with respect to security, wind and noise exclusion, fit-and-finish, etc.

Optionally, the configured end portion of the elongated slot in the track(s) of a sliding window assembly according to this disclosure may be designed for an over-travel condition in the closed position. In such over-travel embodiments, the configured end portion of the elongate slot continues, e.g., arcuately around a fixed pivot pin in the track or other guide surface, past 90° to the plane of the sliding pane. Such over-travel condition can advantageously resist inward force applied against the sliding pane and so effectively lock the sliding pane in the closed position until released. Release can be accomplished, for example, by manual operation of a handle attached to the cam, e.g., attached to a cam rod which includes the cam, to rotate the cam and so guide the travel pin in the configured end portion of the elongate slot toward the main portion of the elongate slot for lateral sliding. Other cams in the window assembly can act as a slave to the handle's operation. For example, in certain exemplary embodiments a cam rod is mounted to a vertical side of a square or rectangular sliding pane and provides a cam and slide movement at the top corner and another cam and slide movement at the bottom corner. The cam rod is rotationally operated by a manual handle mounted to the sliding pane, e.g., mid-way between the top and bottom corners. A second cam rod mounted to the opposite vertical side of the sliding pane provides a cam and slide movement at the top corner at that side of the pane and another cam and slide movement at the bottom corner. A link is provided between the two cam rods such that rotation of the first cam rod to initiate opening of the sliding pane (or in the opposite direction to move the sliding pane to the fully closed position) causes corresponding rotation of the second cam rod. The link can be, e.g., a rigid member connecting the two travel pins of the cam and slide movements. Such link can sit, e.g., in a channel or rabbet or the like in a frame of the sliding pane. Additional and alternative suitable linkages will be apparent to those skilled in the art given the benefit of this disclosure. As noted above, the sliding pane(s) of the window assemblies disclosed here may be operated either by power, manually or in certain exemplary embodiments by both, and certain exemplary embodiments can provide advantages in this regard. In power operated embodiments, the resistance of the drive system to movement other than upon actuation of the drive system by applying a source of electrical power can provide good resistance to inward force applied against the sliding pane and so effectively lock the sliding pane in the closed position. For power operation, the slider or yolk, for example, can be attached, to a cable or rigid drive member of a drive system, e.g., a push-pull cable drive system or pull-pull cable drive system having a motor-driven winch, spool or the like. In certain exemplary embodiments a rod or other rigid member can be used to transfer load, i.e., opening and closing force, to the sliding pane via a spline-on-gear cabling system. Optionally, a quick disconnect device or method can be used to attach such rod or the like to the traveler. Additional and alternative power operation systems suitable for sliding window assemblies disclosed here are known in the motor vehicle industry and their adaptation to the window assemblies disclosed here will be apparent to those skilled in the art given the benefit of this disclosure.

Figure 3:
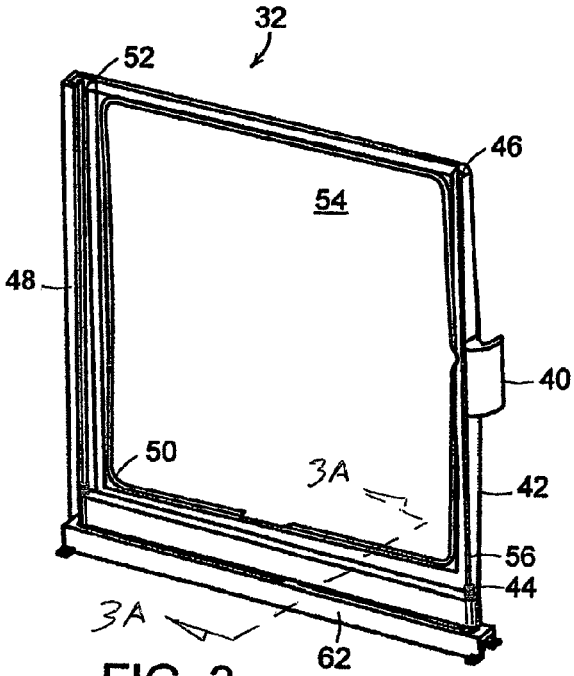
FIG. 3 is a schematic perspective view of the sliding pane assembly of the sliding window assembly of FIG. 1, showing the sliding pane with a full perimeter molded frame, a manually operated handle connected to a cam and slide movement, and also showing the associated lower track.
Figure 3A:
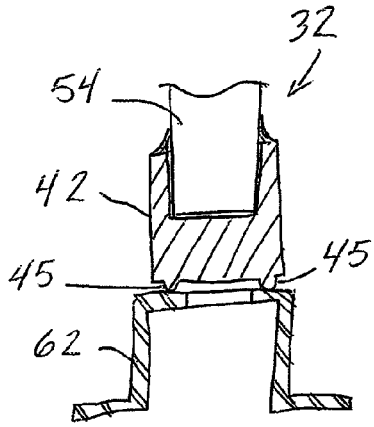
FIG. 3A is a schematic secion view of the sliding pane of FIG. 3 on the associated lower track.
Figure 4:
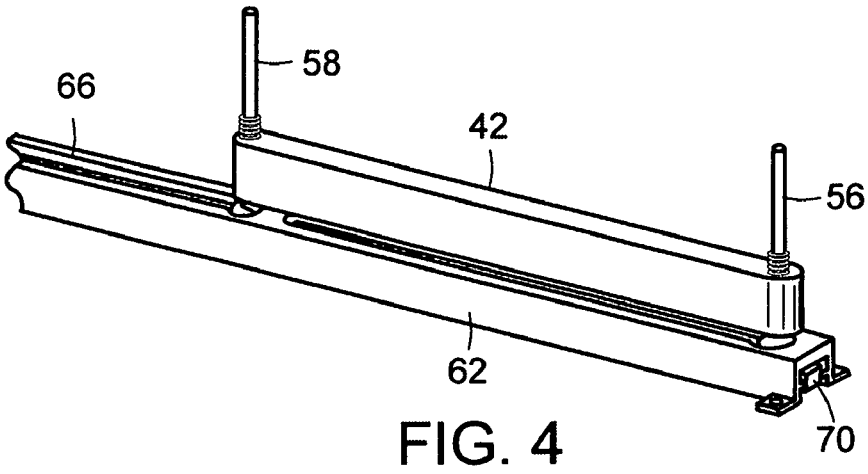
FIG. 4 is a schematic perspective view, partially enlarged and partially broken away, of the track of FIG. 3 in association with a simplified schematic representation of the lower horizontal portion of the molded frame of the sliding pane, wherein the sliding pane is in the fully closed, over-travel position.
Figure 5:
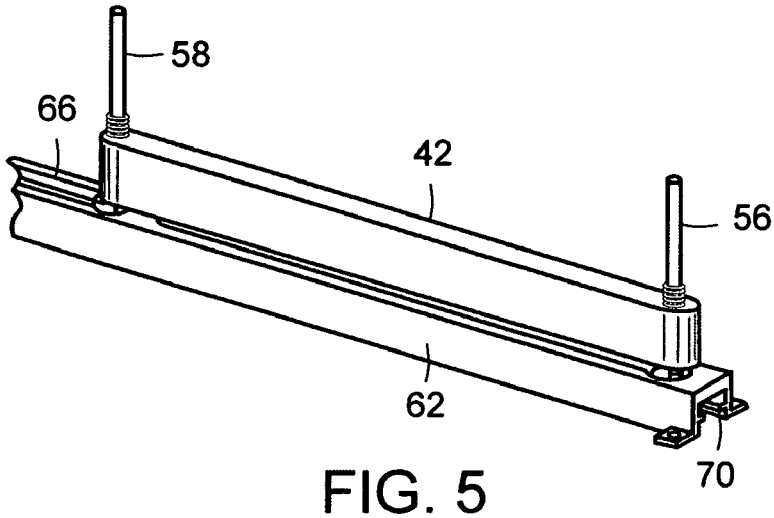
FIG. 5 is a schematic perspective view, partially broken away, corresponding to FIG. 4, wherein the sliding pane has moved to the fully actuated position, that is, out of the over-travel position to the beginning of the main lateral translation portion of the elongate slot of the track.
Figure 6:
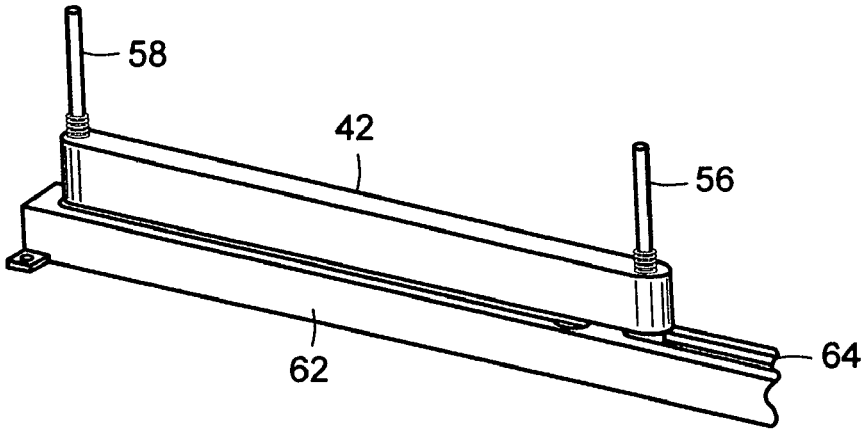
FIG. 6 is a schematic perspective view, partially broken away, corresponding to FIGS. 4 and 5, wherein the sliding pane is shown in the fully open position, having translated, i.e. moved laterally, to the left as viewed in FIG. 6.
Figure 8:
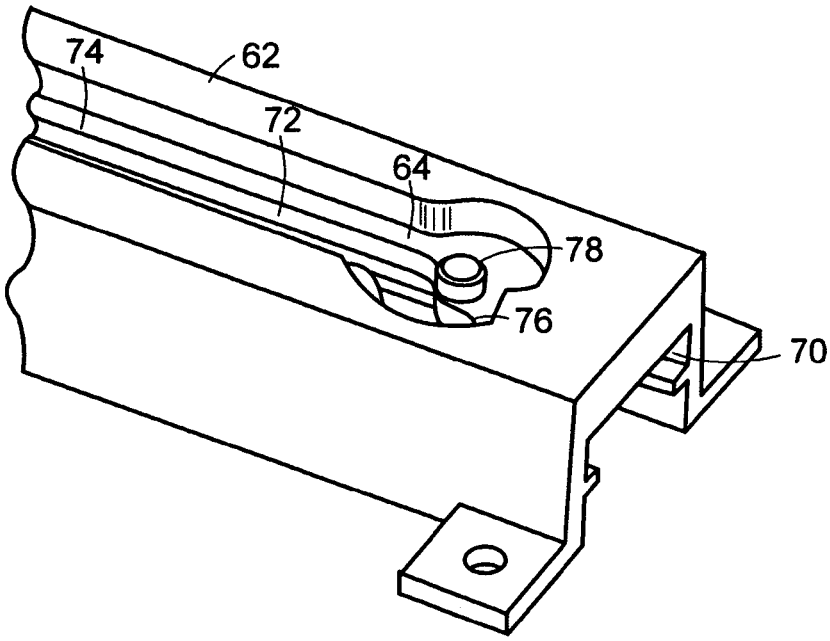
FIG. 8 is a schematic perspective view of the lower track of the window assembly, enlarged and partially broken away, showing a fixed pivot pin and configured in portion of the elongate slot of the track.
Figure 9:
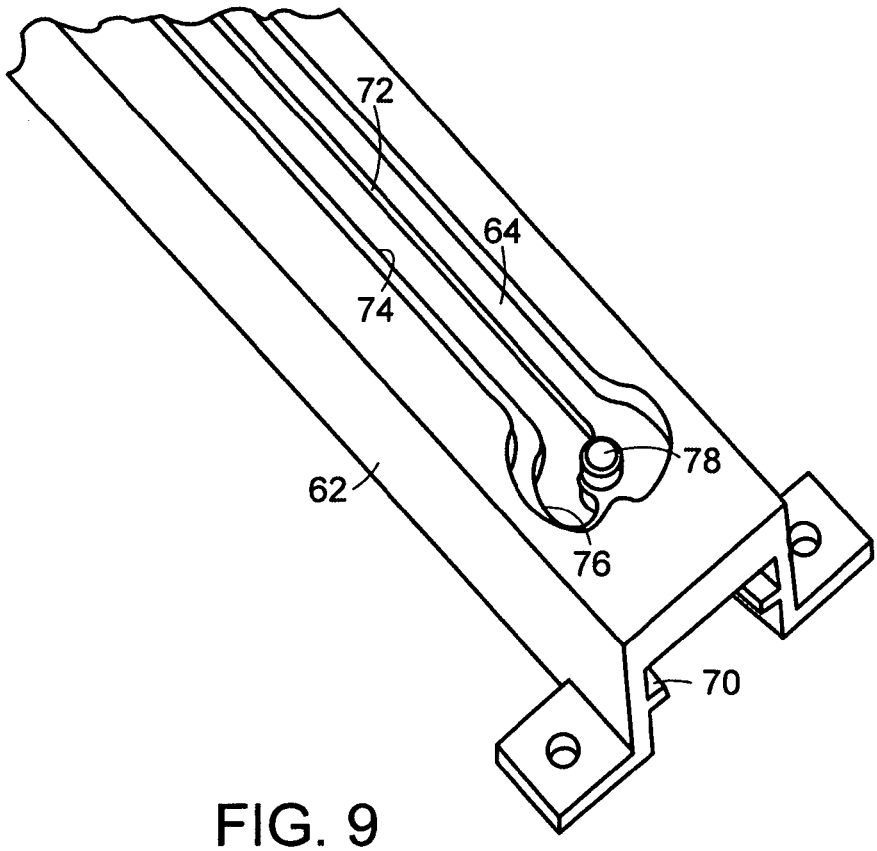
FIG. 9 is a schematic perspective view, partially broken away, of the track of FIG. 8 viewed from a different angle.
Figure 10:
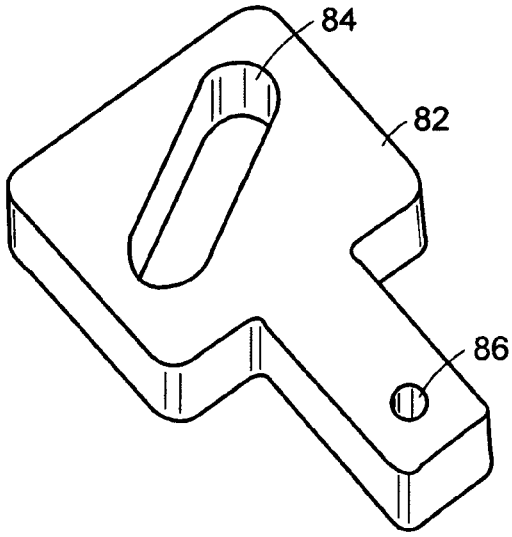
FIG. 10 is a schematic perspective view of the traveler or yolk or slide of the window assembly of FIG. 1.
Figure 11:
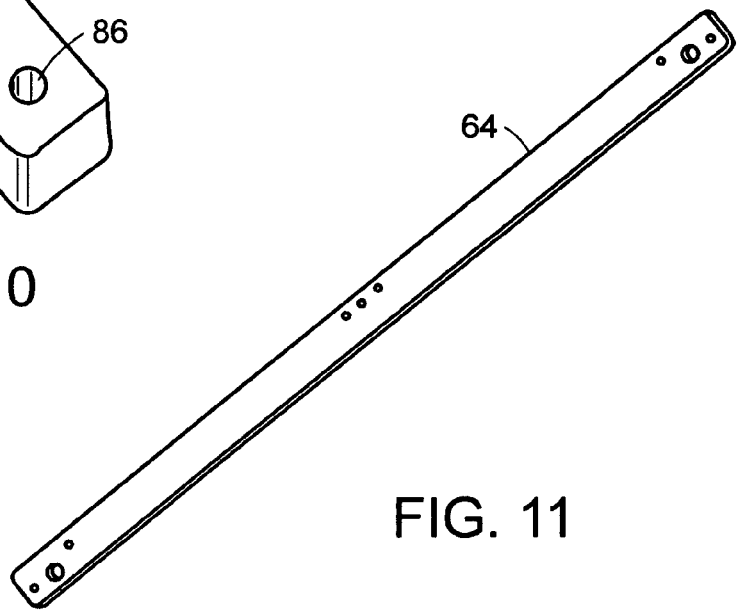
FIG. 11 is a schematic perspective view of a link of the window assembly of FIG. 1.
Figure 12:
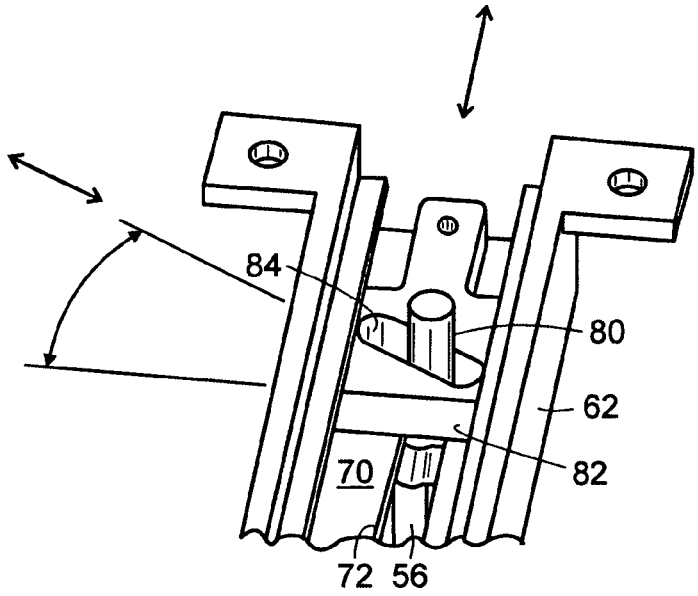
FIG. 12 is a schematic perspective view of the track of the window assembly of FIG. 1 in assembly with the traveler and elements of the associated cam and slider movement, viewed from below (i.e. viewed from the side opposite that of FIGS. 8 and 9)
Figure 13:
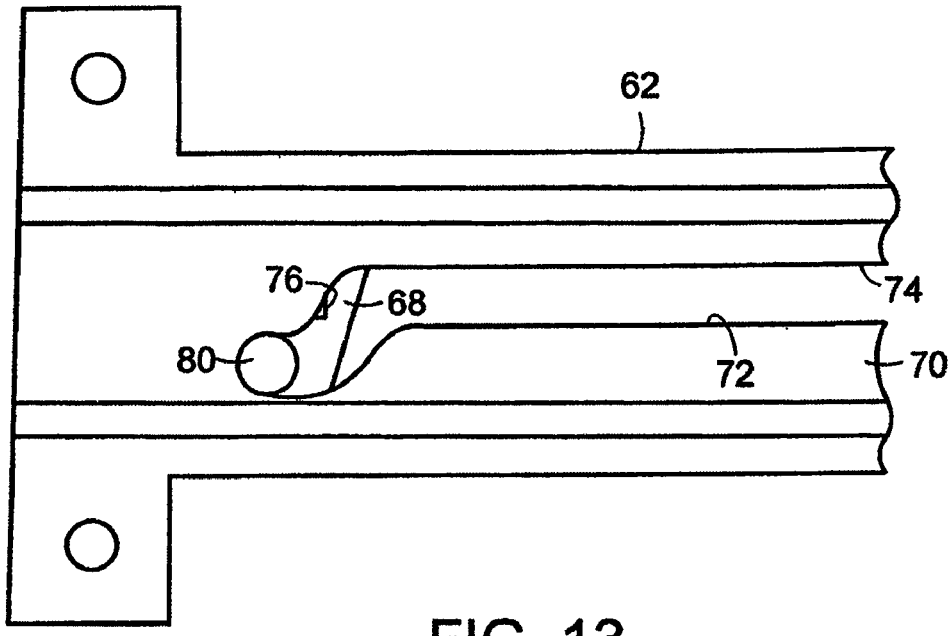
FIG. 13 is a schematic plan view, partially broken away, of the track in assembly with the associated cam and slide movement, illustrating the travel pin of the cam and slide movement in the configured portion of the elongate slot of the track.

Referring now to the drawings, a sliding window assembly 30 is seen to comprise a center sliding pane assembly 32, a right-side fixed pane 34 and a left-side fixed pane 36, all mounted in a full circumference peripheral molded frame 38. It can be seen that the sliding pane is mounted in a vertical plane for horizontal translation, that is, for horizontal sliding. Sliding pane 32 in the illustrated embodiment is manually operable having manually operable handle 40 mounted to molded frame 42 of the sliding pane assembly approximately half-way between lower right corner 44 and upper right corner 46. The molded frame of the sliding pane comprises a laterally extending flange 48 running vertically on the right-side of the sliding pane assembly from lower left corner 50 to upper left corner 52. Sliding pane 54 may be any suitable glazing material including, for example, glass, plastic, a laminate, etc. A cam and slider movement is provided for each of the four corners of sliding pane assembly 32. Specifically, a cam rod 56 is attached to handle 40 for rotation by operation of handle 40. Cam rod 56, as discussed further below, provides a travel pin and cam at its lower end at corner 44 of the sliding pane and another cam and travel pin set at upper corner 46. A slave cam rod 58 correspondingly extends vertically along left vertical side sliding pane 32 and provides a cam and travel pin assembly at upper left corner 52 and another cam and travel pin set lower corner 50. The cam and travel pin set at upper right corner 46 and the cam and travel pin set at upper left corner 52 travel in an upper horizontal track integrated into peripheral mold 38 of the window assembly. Correspondingly, the cam and travel pin set at lower right corner 44 and the set at lower left corner 50 travel in lower horizontal track 62. Lower track 62 is parallel to the upper track and also is integrated into the molded frame 38 of the window assembly. A link 64 (See FIG. 11) between the cam and slide movement at lower right corner 44 and the cam and slide movement at lower left corner 50 synchronizes the movement of cam rod 56 and slave cam rod 58. Molded frame 42 may include ride bumps 45 (see FIG. 3A), protecting to lower track 62 and supporting sliding pane 32 on lower track 62.

The operation of the cam and slide movements in upper track are substantially the same as the operation of those in the lower track. Accordingly, for purposes of illustration, the following discussion will focus on the lower track 62 and the associated cam and slider movements. Collectively, the upper and lower tracks and the cam and slide movements at each corner may be referred to as travel guide apparatus of the window assembly. In this regard, it will be understood by those skilled in the art, given the benefit of this disclosure, that alternative configurations may be used for the upper and lower tracks including, for example, a pair of tracks in line with each other rather than one extended length track for the upper and/or lower. In the illustrated embodiment, lower track 62 provides a longitudinally extending first slide way 64 and longitudinally extending second slide way 66. A slide ways are support surface for the sliding pane assembly. More specifically, in the illustrated embodiment lower surface 68 of cam 60 of cam rod 56 bears down on slide way 64 at bottom left corner 44 of the sliding pane. Because the configuration and operation of the cam and slide movement for lower left corner 50 is substantially the same as that of the cam and slide movement for lower right corner 44, it would not be separately described. Lower track 62 also forms longitudinally extending track way 70 below the slide way 64. The corresponding track way under slide way 66 of the track may be provided simply as an extension without interruption of track way 70. An elongate slot 72 is provided through the slide way 664 to the track way 70. Elongate slot 72 includes at lease a main elongate portion 74 and a configured end portion 76. The main elongate portion 74 extends along the travel path of the sliding pane in a vertical plane corresponding to the offset plane of the open position of the sliding pane. In the illustrated embodiment, the offset pane is inboard of the plane occupied by the sliding pane when it is in its closed position flushed with the adjacent fixed panes 34, 36 of the window assembly. A fixed pivot pin 78 extends upwardly from the surface of slide way 64. Pivot pin 78 provides a fixed guide surface against which cam 60 bares in the final stage closing the sliding pane and in the initial stage of opening the sliding pane, as now further described. Cam rod 56 provides at its lower end, in addition to the aforementioned cam 60, a travel pin 80. Travel pin 80 extends downwardly from cam 60 through elongate slot 64 into track way 70. In track way 70 travel pin 80 engages traveler 82. Traveler 82 is slideably mounted in track way 74 longitudinal travel therein. Travel pin 80 extends into elongate traveler slot 84 such that travel pin 80 (and, therefore, cam rod 56 and, therefore, the sliding pane assembly) travels in synchrony with traveler 82. The elongate nature of traveler slot 84 permits it to accommodate inboard/outboard movement of travel pin 80 during its travel in configured end portion 76 of the elongate slot 72. Preferably, the traveler is configured and sized to slide smoothly but without room for rattle or vibration in the track way 70. In accordance with certain alternative embodiments, the traveler for the cam and slider movement at the lower right corner can be unitary with the traveler for the cam and slider movement for the lower left corner of the sliding pane. The Traveler in that case is an elongate member extending from one side of the sliding pane to the other in the track way 70. Also, it will be recognized that where a pull-pull power drive system is used for the siding pane, an attachment point must be provided additional to through bore 86 for attachment of a cable in the opposite direction. Traveler 82 is seen to have a through bore 86 suitable for attachment to a cable or rod member of a power drive system. Alternatively, through bore 86 may be used to attach a link to the traveler in the adjacent track way under slide way 66. Alternatively, such linkage can be attached to the travel pin 80 and the corresponding travel pin at lower right corner 50 of the sliding pane assembly.

Figure 14:
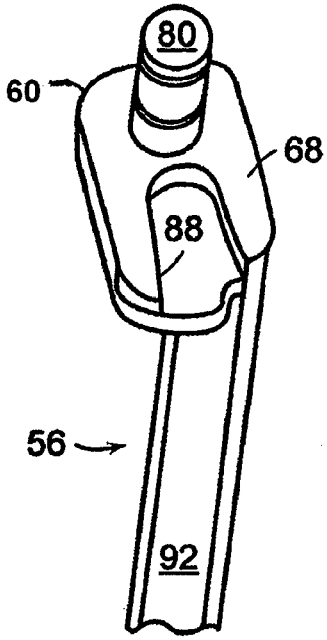
FIG. 14 is a schematic perspective view, partially broken away, of the cam rod of the window assembly of FIG. 1, showing the travel pin, cam and associated elongate rod for mounting to the molded frame of the FIG. 15 is another schematic perspective view, partially broken away, of the cam rod of the FIG. 14.
Figure 15:
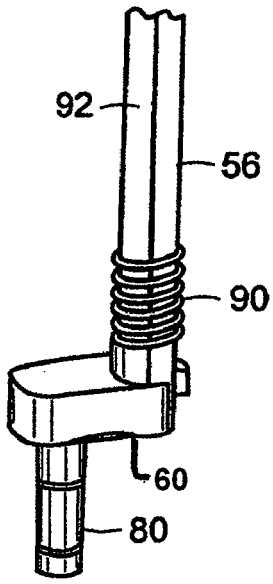
Figure 17:
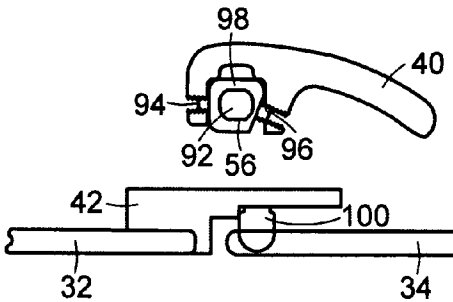
FIGS. 17 and 18 are schematic section views, partially broken away, taken through line B1/B1 of FIG. 16, showing the manually operable handle in the closed and open position, respectfully.
Figure 18:
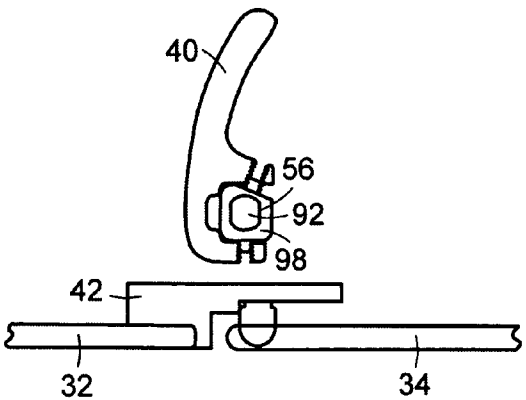
Figure 19:
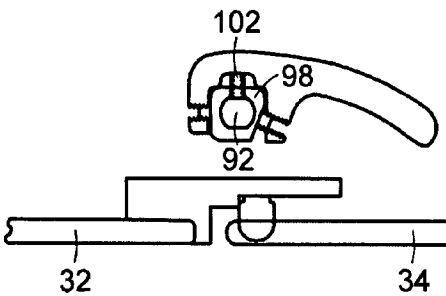
FIG. 19 is a schematic perspective view, partially broken away, taken through line B2/B2 of FIG. 16.
Figure 16:
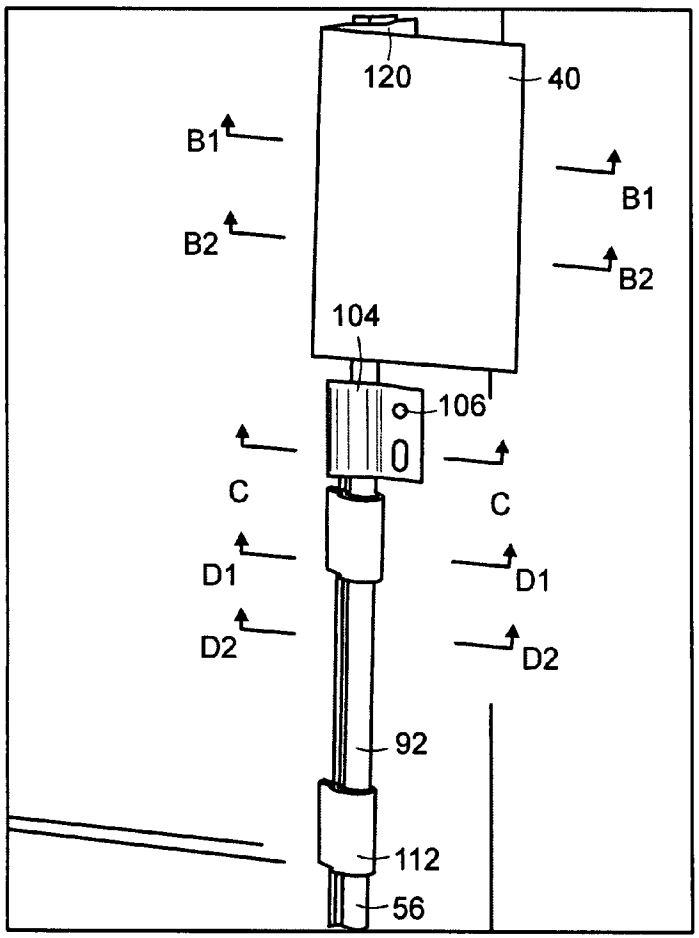
FIG. 16 is an enlarged schematic perspective view of the manual handle and cam rod mounting area of the sliding pane assembly of FIG. 3.

Cam 60 is seen to have a recess 88 configured and operative to receive pivot pin 78 as the sliding of the pane approaches the closed position from the open position. Cam 60 receives fixed pivot pan 78 into recess 88 and rotatably bears against the pivot pin to urge sliding pane from the off-set second plane of the open position toward the flushed plane of the closed position as the travel pin moves in the configured end portion 76 of elongate slot 72. In the illustrated embodiment, travel pin 80 in the main portion 74 of elongate slot 72 is in line with and parallel to pivot pin 78. Optionally, vertical biasing means are provided, for example, to ensure good contact of the cam rod in the slide way to reduce vibration, rattle etc., and/or to properly position the components. In the illustrated embodiment, a coil spring 90 is provided on cam rod 56. Numerous alternative biasing means will be apparent to those skilled in the art, given the benefit of this disclosure. As best seen in FIGS. 14 and 15, cam rod 56 includes a vertically extending rod portion 92. As discussed above, rod portion 92 extends along the vertical right-side of the sliding pane assembly to a cam and slider movement at the top right corner 46 of the sliding pan assembly. In FIG. 16, manual handle 90 is illustrated along with additional components of the sliding pane assembly. In FIG. 17, handle 40 is seen in the closed position. Set screws 94, 96 affix handle 40 to jacket 98, whereby handle 40 is rotationally fixed to rod portion 92 of cam rod 56. Molded frame 42 of the sliding pane assembly carries weather seal 100 for closure with fixed pane 34. In FIG. 18 handle 40 has been rotated counter-clockwise (as viewed in FIG. 18) is such that cam rod 92 is correspondingly rotated. By operation of such rotation, cam 60 has pivoted about fixed pin 78 causing travel pin 80 to move or travel in end portion 76 of elongate sock 72. Thus, sliding pane 32 is now able to translate or slide toward the open position. FIG. 19 taken through line B2-B2 in FIG. 16, shows set screw 102 whereby cam rod 92 is attached and rotationally fixed to jacket or coupler 98. Suitable alternative or additional attachment techniques will be apparent to those skilled in the art given the benefit of this disclosure.

Figure 20:
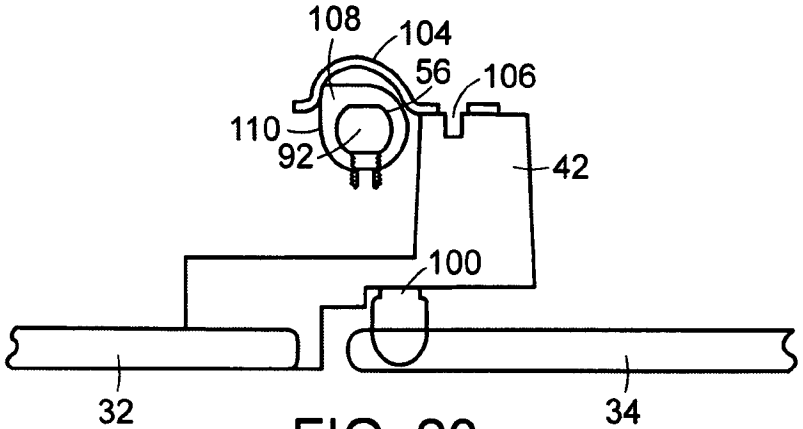
FIGS. 20 and 21 are schematic section views, partially broken away, taken through line C/C of FIG. 16 illustrating the spring-keeper of the cam and slider movement of the window assembly of FIG. 1.
Figure 21:
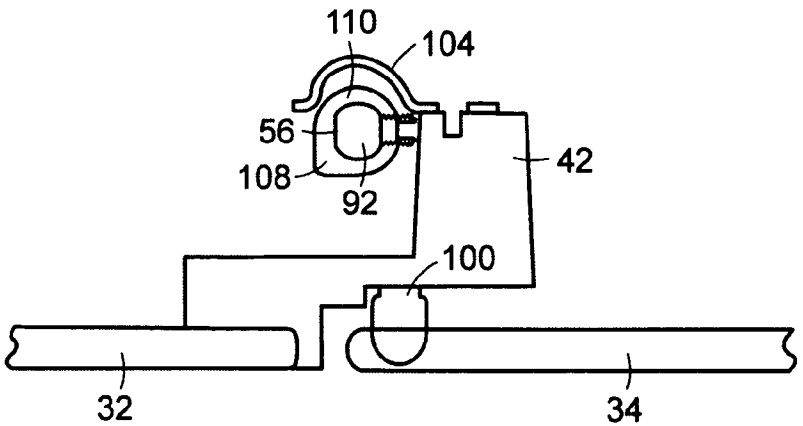
Figure 24:
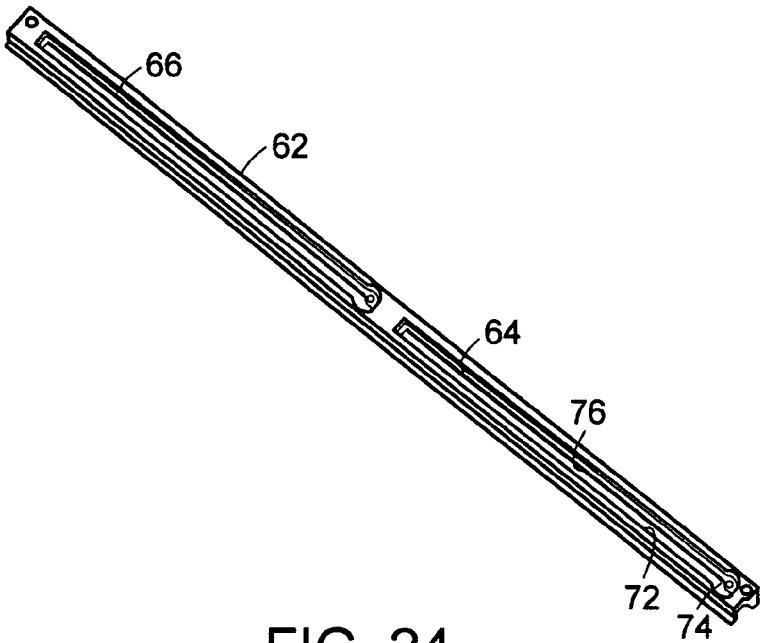
FIG. 24 is a schematic perspective view of the upper or lower track of the window assembly of FIG. 1.
Figure 22:
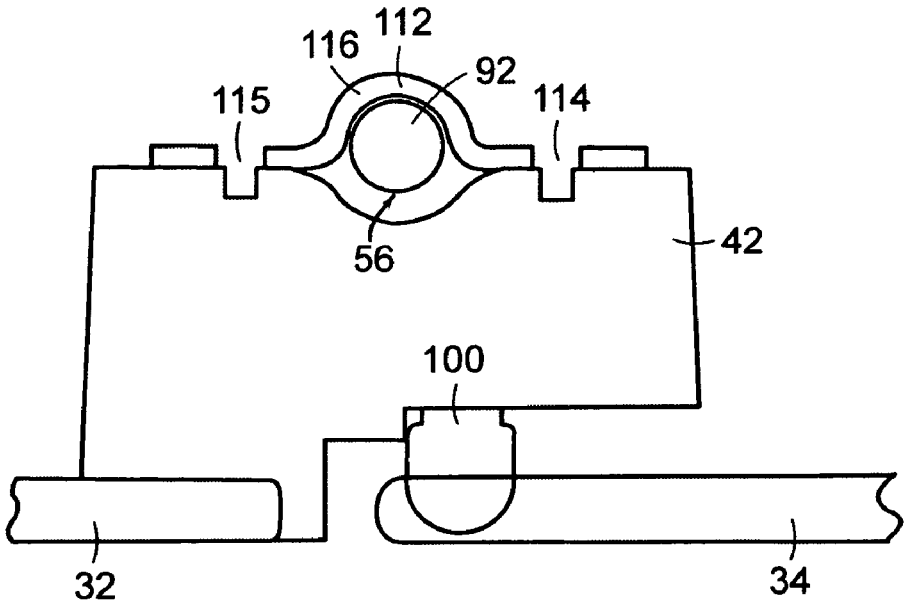
FIG. 22 is a schematic perspective view, partially broken away, taken through line D1/D1 of FIG. 16, showing a cam rod retainer of the window assembly of FIG. 1.
Figure 23:
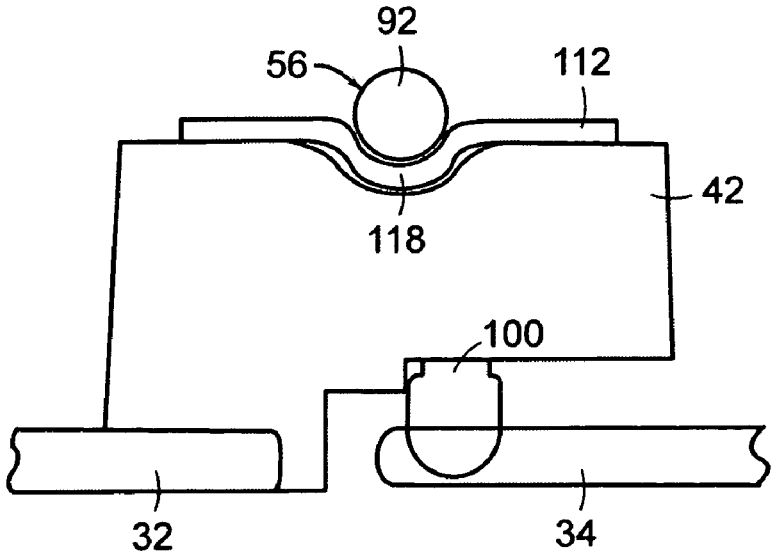
FIG. 23 is a schematic perspective view, partially broken away, taken through line D2/D2 of FIG. 16, showing a different portion of the cam rod retainer.

FIGS. 20 and 21 show spring-keeper 104 in its closed and open positions, respectfully. Spring-keeper 104 is attached to molded frame 42 by threaded screws including screw 106. In certain exemplary embodiments spring-keeper 104 is formed of spring steel or other suitable material with resilience and shape memory. As seen in FIG. 20, node 108 on keeper 110 is captured by spring-keeper 104. In FIG. 21, corresponding to the open position, node or projection 108 has been rotated out of spring-keeper 104. Spring-keeper 104 provides resilient resistance to node 108 of keeper 110 in both the opening and closing directions, and serves primarily to retain the cam rod in the closed position until the manual operation of handle 40 over comes spring-keeper 104. It will be recognized by those skilled in the art, given the benefit of this disclosure, that numerous alternative suitable techniques are available for mounting cam rod 56 to the sliding pane. In the illustrated embodiment, one or more cam retainers 112 are employed. Cam retainer 112 is attached to molded frame 42 by threaded screws 114, 115 or other suitable means. Rod portion 92 of cam rod 56 extends through cam retainer 112, being seated in alternatingly convex and concave portions of the cam retainer. In FIG. 22, rod portion 92 is captured under convex portion 116. In FIG. 23 rod portion 92 extends in concave portion 118. It will be recognized that cam rod 56 may be a single unitary (i.e. one piece) device or it may be assembled such that travel pin 80, cam 60 etc. are integral with one another but not unitary. Likewise, frame 62 may be a single unitary device or may be assembled of multiple components. For example, pivot pin 78 may be unitary with the frame or may be thread idly attached, etc. Also, it will be recognized that both the upper and lower tracks may be provided as suitable configurations in the peripheral molded frame of the window assembly. While the cam rod of the illustrated embodiment has been described as extending vertically from the top corner to the bottom corner, it will be recognized that separate cam rods may be employed and, optionally, coupled to one another, e.g., by a coupler mounted to the vertical portion of the molded frame between the upper and lower corners. Optionally, a rotational biasing member is employed in the sliding pane assembly, for example, a spring 120 providing bias between the molded frame and handle 40. Such rotational biasing member may provide bias either toward or away from the open position.

While certain particular embodiments of the invention have been illustrated and described above, it will be apparent to those skilled in the art, given the benefit of this disclosure, that numerous modifications and additions can be made without departing from the true spirit and scope of the invention. Accordingly, it is not intended that the invention be limited except in accordance with the terms of the following claims. In the following claims, definite and indefinite articles such as "the," "a," "an," and the like, in keeping with traditional patent law and practice, mean "at least one" of the item. In general, unless expressly stated otherwise, all words and phrases used in the disclosure above and in the following claims are intended to have all of their various different meanings, including, without limitation, any and all meaning(s) given in general purpose dictionaries, and also any and all meanings given in applicable science, technology and engineering dictionaries, and also any and all meanings known in the relevant industry, technological art or the like. Thus, where a term has more than one possible meaning, all such meanings are intended to be included for that term as used here unless nonsensical or inconsistent with the disclosed principles of the invention. In that regard, it should be understood that if a device, system or method has the item called for in a claim below (i.e., it has the particular feature or element called for), and also has one or more others of that general type of item but not specifically as called for in the claim, then the device, system or method in question satisfies the claim requirement. Those one or more other items that don't also meet the claim requirement are simply extra and can be ignored in determining whether the device, system or method in question satisfies the claim requirement.

The claimed invention is:

1. A sliding window assembly comprising, in combination:

at least one sliding pane mounted for travel along a travel path between a closed position in a first plane, and an open position in an offset second plane substantially parallel to the first plane; and travel guide apparatus for guiding the sliding pane as it moves along the travel path between the open and closed positions, comprising:

a first track forming a first elongate slot comprising a main elongate portion extending along the travel path in a plane corresponding to the offset second plane, and a first slot end portion extending from the main elongate portion toward the first plane;

a first fixed guide surface having a fixed position relative to the first elongate slot proximate the first slot end portion; and a first cam and slide movement comprising a first traveler slidably mounted in the first track for longitudinal travel along the first elongate slot and having a first elongate traveler slot extending longitudinally at an angle of 30°to 90° to the main elongate portion of the first elongate slot, a first travel pin extending from the sliding pane into the first elongate slot and the first traveler slot, and a first cam integral with the first travel pin and rotatably mounted to the sliding pane and operative to contact the first fixed guide surface as the sliding pane approaches the closed position and to rotatably bear against the first fixed guide surface to guide the sliding pane from the offset second plane toward the first plane as the sliding pane then travels further toward the closed position, wherein the first fixed guide surface is a pin.

2. The sliding window assembly of claim 1 wherein the cam and travel pin are at a first end of a first mounting rod rotatably attached to the sliding pane.

3. The sliding window assembly of claim 1 wherein the sliding pane is at least partly supported during sliding between the open and closed positions by the cam slidingly bearing against the first track.

4. The sliding window assembly of claim 1 wherein a. the first fixed guide surface is a first fixed pin integral with the first track, b. the first slot end portion is arcuate about the longitudinal axis of the first fixed pin, and c. the first cam has a recess configured to receive the first fixed pin as the sliding pane approaches the closed position and to rotate around the first fixed pin to guide the travel pin in the arcuate first end slot as the sliding pane then travels further toward the closed position.

5. The sliding window assembly of claim 1 wherein the first fixed guide surface is a first fixed pin unitary with the first track.

6. The sliding window assembly of claim 1 wherein the elongate direction of the first traveler slot is an angle between of 30°to 45°to the longitudinal direction of the main elongate portion of the first elongate slot.

7. The sliding window assembly of claim 1 further comprising at least one fixed-position pane.

8. The sliding window assembly of claim 1 further comprising a molded frame around at least a portion of a peripheral edge of the sliding pane.

9. The window assembly of claim 8 wherein the molded frame comprises ride bumps projecting to the first track and supporting the sliding pane in the first track.

10. The window assembly of claim 1 wherein the first travel pin and first cam are unitary with each other.

11. A flush-closing multi-pane window assembly for a motor vehicle body enclosing a passenger compartment, comprising, in combination:

a window assembly frame;

at least one fixed-position pane having an inside surface facing the passenger compartment and an outside surface facing outboard, mounted vertically in a fixed position in the window assembly frame;

at least one sliding pane assembly mounted vertically in the window assembly frame for travel horizontally along a travel path between a closed position in a first plane in which the outside surface of the sliding pane is flush with the outside surface of the fixed-position pane, and an open position in which the sliding pane assembly at least partly overlaps the fixed position pane in an offset second plane parallel to the first plane, the sliding pane comprising i. a generally rectilinear sliding pane having an inside surface, an outside surface and a perimeter edge, and ii. a molded frame extending along at least a portion of the perimeter edge and having at least a first upper corner, a second upper corner, a first lower corner, a second lower corner, a first horizontal portion extending between the first and second upper corners, and a second horizontal portion extending between the first and second lower corners, the second horizontal portion being parallel to the first horizontal portion; and travel guide apparatus for guiding the sliding pane assembly as it moves along the travel path between the open and closed positions, comprising:

an elongate horizontal first track mounted horizontally in a fixed position in the window assembly frame below the sliding pane assembly and forming a longitudinally extending first slideway providing support for the sliding pane assembly, longitudinally extending first trackway below the first slideway, a first elongate slot through the first slideway to the first trackway, comprising a. a main elongate portion extending along the travel path in a plane corresponding to the offset second plane, and b. an end portion corresponding to the closed position of the first lower corner of the sliding pane assembly, extending the travel path from the main elongate portion toward the first plane;

a longitudinally extending second slideway providing support for the sliding pane assembly;

longitudinally extending second trackway below the second slideway; and a second elongate slot through the second slideway to the second trackway, comprising a. a main elongate portion extending along the travel path in a plane corresponding to the offset second plane, and b.an end portion corresponding to the closed position of the second lower corner of the sliding pane assembly, extending the travel path from the main elongate portion toward the first plane;

an elongate horizontal second track mounted horizontally in a fixed position in the window assembly frame parallel to the first track and above the sliding pane assembly and forming a longitudinally extending third slideway, longitudinally extending third trackway above the third slideway, a third elongate slot through the third slideway to the third trackway, comprising a. a main elongate portion extending along the travel path in a plane corresponding to the offset second plane, and b. an end portion corresponding to the closed position of the first upper corner of the sliding pane assembly, extending the travel path from the main elongate portion toward the first plane;

a longitudinally extending fourth slideway;

longitudinally extending fourth trackway above the fourth slideway; and a fourth elongate slot through the fourth slideway to the fourth trackway, comprising a. a main elongate portion extending along the travel path in a plane corresponding to the offset second plane, and b. an end portion corresponding to the closed position of the second upper corner of the sliding pane assembly, extending the travel path from the main elongate portion toward the first plane;

a first fixed pivot pin integral with the first track and positioned proximate the end portion of the first elongate slot;

a second fixed pivot pin integral with the first track and positioned proximate the end portion of the second elongate slot;

a third fixed pivot pin integral with the second track and positioned proximate the end portion of the third elongate slot;

a fourth fixed pivot pin integral with the second track and positioned proximate the end portion of the fourth elongate slot; and a cam and slide movement at each corner of the sliding pane assembly, each comprising:

a traveler slidably mounted for longitudinal travel in the respective trackway and having an elongate traveler slot extending longitudinally at an angle of 30°to 90°to the main elongate portion of the respective elongate slot, a cam rod mounted to the sliding pane assembly and extending vertically beyond the respective corner of the sliding pane assembly, comprising a vertically extending rod, a cam integral with the rod and rotatable in a plane perpendicular to the longitudinal axis of the rod, slidingly received in the respective slideway and having a recess operative to receive the respective fixed pivot pin as the sliding pane approaches the closed position and to rotatably bear against the respective fixed pivot pin to urge the sliding pane from the offset second plane toward the first plane as the sliding pane travels further toward the closed position, and a travel pin integral with the rod and extending to the respective elongate slot of the respective track and the respective elongate traveler slot of the respective traveler.

12. The flush-closing multi-pane window assembly of claim 11 wherein the cam rod at the first upper corner and the cam rod at the first lower corner are unitary with each other.

13. The flush-closing multi-pane window assembly of claim 11 wherein the cam rod at the first upper corner and the cam rod at the first lower corner are coupled for synchronized rotation.

14. The flush-closing multi-pane window assembly of claim 11 wherein the cam rod at the first upper corner and the cam rod at the first lower corner are coupled by a first coupler mounted to a first vertical portion of the molded frame extending along the first vertical edge of the sliding pane, and the cam rod at the second upper corner and the cam rod at the second lower corner are coupled by a second coupler mounted to a second vertical portion of the molded frame extending along the second vertical edge of the sliding pane.

15. The flush-closing multi-pane window assembly of claim 14 further comprising a manually operable handle mounted to the first vertical potion of the molded frame extending along the first vertical portion of the molded frame for limited rotation about a vertical axis, wherein the handle is operative upon rotation to rotate the first coupler for synchronized rotation of the cam rod at the first upper corner and the cam rod at the first lower corner upon operation of the handle.

16. The flush-closing multi-pane window assembly of claim 15 further comprising a first rotational biasing member operative to rotationally bias the handle.

17. The flush-closing multi-pane window assembly of claim 11 further comprising a vertical biasing member operative to vertically bias at least one cam rod.

18. The flush-closing multi-pane window assembly of claim 11 further comprising a seal carried by the molded frame and operative in the closed position to sealingly seat against the inside surface of the fixed pane.

19. The flush-closing multi-pane window assembly of claim 11 wherein the end portion of the first elongate slot and the end portion of the second elongate slot are configured for an over-travel condition in the closed position, wherein the end portion continues past 900 to the plane of the sliding pane.

* * * * *